US005692475A

United States Patent [19]

Rodriguez-Amaya

[11] Patent Number: 5,692,475

[45] Date of Patent: Dec. 2, 1997

[54] FUEL INJECTION PUMP FOR INTERNAL COMBUSTION ENGINES

[75] Inventor: Néstor Rodriguez-Amaya, Stuttgart, Germany

[73] Assignee: Robert Bosch GmbH, Stuttgart, Germany

[21] Appl. No.: 751,063

[22] Filed: Nov. 15, 1996

[30] Foreign Application Priority Data

Nov. 18, 1995 [DE] Germany ..... 195 43 116.2

[51] Int. Cl.[6] ..... F07M 41/00

[52] U.S. Cl. ..... 123/450; 251/355

[58] Field of Search ..... 123/450; 417/462; 251/625.11, 625.47, 355

[56] References Cited

U.S. PATENT DOCUMENTS

| | | | |
|---|---|---|---|
| 3,096,070 | 7/1963 | Wolfensperger | 251/355 |
| 4,522,174 | 6/1985 | Babitzka et al. | 123/450 |
| 5,207,201 | 5/1993 | Schlagmuller . | |
| 5,465,691 | 11/1995 | Capaldo | 251/355 |

FOREIGN PATENT DOCUMENTS

| | | |
|---|---|---|
| 2449332 | 4/1976 | Germany . |
| 540616 | 10/1941 | United Kingdom . |
| 1508234 | 4/1978 | United Kingdom . |
| 1577954 | 10/1980 | United Kingdom . |
| 85/04449 | 10/1985 | WIPO . |

*Primary Examiner*—Thomas N. Moulis
*Attorney, Agent, or Firm*—Edwin E. Greigg; Ronald E. Greigg

[57] ABSTRACT

A fuel injection pump for internal combustion engines which has a moving part supported in a housing bore and on its jacket face on one side, has an exit opening that is under high pressure, and whose bearing is improved by virtue of the fact that at least one closed annular groove is provided on the jacket face of the part or in the wall of the housing bore, axially adjacent to the exit opening. As a result, a more even pressure distribution of the pressure field prevailing in the regions of the exit opening is achieved on the circumference of the moving part and as a result, a less damage prone, improved bearing with great high pressure tightness of the moving part is provided.

5 Claims, 1 Drawing Sheet

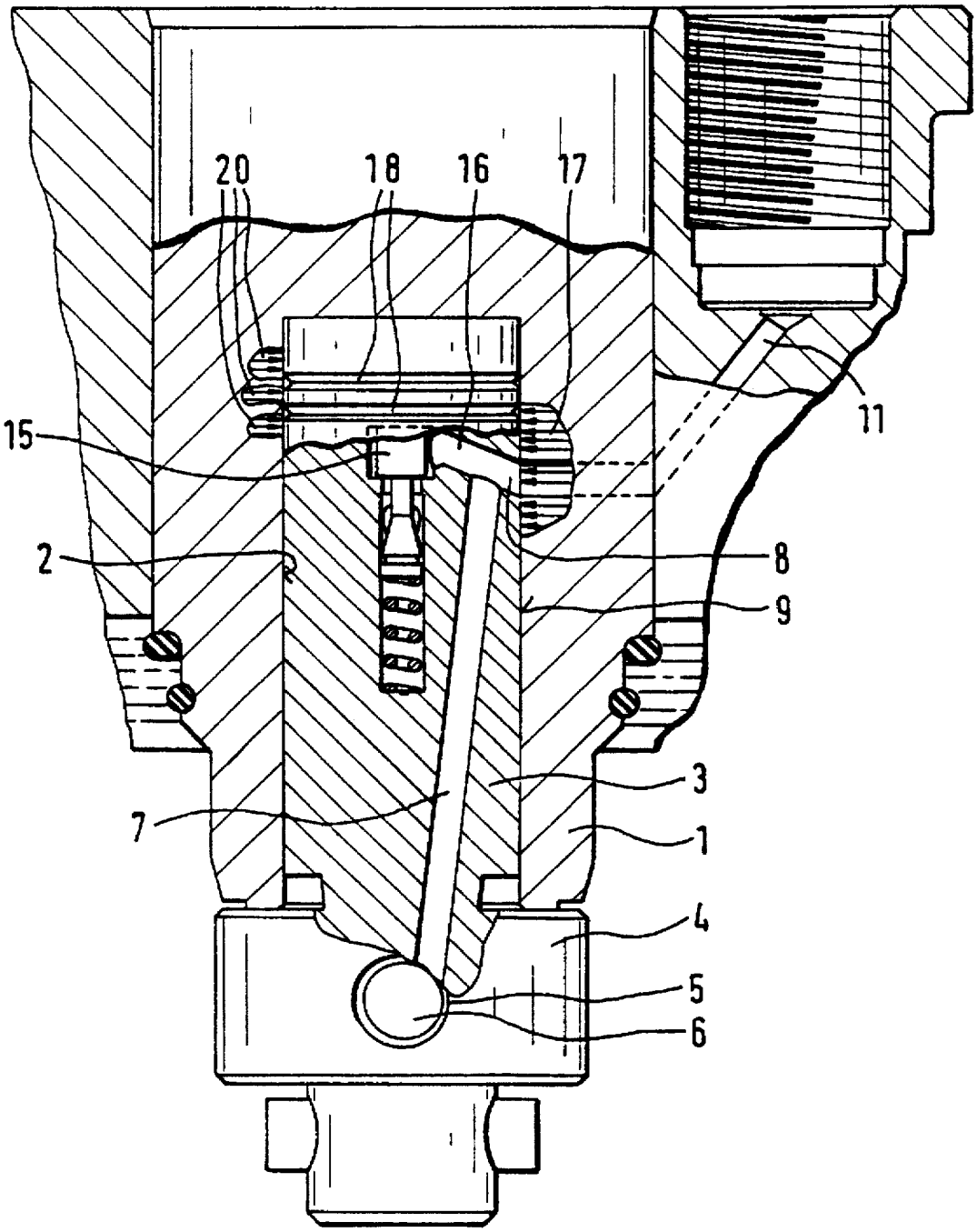
20
18
16
17
15
11
2
8
9
3
7
1
4
5
6

FUEL INJECTION PUMP FOR INTERNAL COMBUSTION ENGINES

BACKGROUND OF THE INVENTION

The invention relates to a fuel injection pump for internal combustion engines. DE-C-24 49 332 discloses a fuel injection pump of this generic type, which has a pump piston that is driven to reciprocate in the housing bore and at the same time is also driven to rotate and with its distributor opening, and is also used as a distributor. In this known fuel injection pump, another longitudinal groove is disposed on the jacket face of the pump piston, possibly disposed opposite the distributor opening, which groove continuously communicates with the fuel that is supplied under high pressure to the distributor opening. With an embodiment of this kind, a pressure application, possibly disposed diametrically opposite the distributor openings, is produced between the pump piston and the housing bore in such a way that the pump piston is evenly loaded by the compression forces and the tendency for the piston to score the inside of the housing bore is prevented. This additional groove regularly comes into connection with injection lines that do not participate in the injection and carries out a pressure compensation between these lines with an injection line opened at the same time by the distributor opening in an intake phase of the pump piston.

This embodiment has the disadvantage that despite the fact that a force compensation is carried out on the pump piston, an interruption of the lubricating oil film occurs by means of the large-surfaced grooves in the jacket face of the distributor or pump piston, which film is intended to carry the pump piston in its rotation in the housing bore of the fuel injection pump.

OBJECT AND SUMMARY OF THE INVENTION

The fuel injection pump according to the invention has the advantage over the prior art that the annular groove produces a connection between the region directly adjacent to the exit opening, between the jacket face of the moving part and the housing bore, and the part disposed diametrically opposite this region. In the region directly adjacent to the exit opening, a high fuel pressure prevails in the narrow gap between the jacket face of the moving part and the housing bore. The high pressure forces prevailing there, together with the pressure field directly in the region of the exit opening carry out a force application of the moving part in the direction of its jacket face disposed diametrically opposite this. Because of the influence of these forces, the remaining gap between the jacket face and the housing bore reduces in size, which in the borderline case also leads to the fact that there is no longer a sufficient supply of lubricating fuel between these two faces to permit a damage-free sliding of these faces relative to each other. Since pressurized fuel can now be transported from the high pressure region adjacent to the exit opening, from the region disposed between the jacket face and the housing bore, to the opposite side, a pressure and force compensation occurs and it is also achieved that there is enough fuel on the side of the jacket face disposed opposite the exit opening to constitute a lubricating wedge. At the same time, it is not required that the annular grooves be additionally supplied with pressurized fuel by other sources of pressurized fuel. In comparison to the costly embodiment according to the prior art, in which the angular position of the additional groove in the jacket face must be precisely taken into account together with the cross sectional area of this groove, here it is possible to significantly reduce the damage prone nature of the fuel injection pump in a very simple manner merely by the placement of annular grooves, which can be let into the jacket face of the moving part and can be equivalently let into the inner jacket face of the housing bore. No additional bores are required and grooves of this kind can be produced in a very simple manner.

The improvement relates to an advantageous application in a distributor fuel injection pump with a rotating distributor as the moving part.

With the embodiment shown, it is achieved that immediately in these regions of a distributor, which are subject to particular displacements from the geometrically provided axis of the distributor, the bearing is improved by means of the measures set forth.

The attachment of the annular grooves is particularly advantageous in a distributor that is only driven to rotate since in this connection, the position of other bores that lead from the housing bore does not have to be defined in view of an additional stroke. In the course of the steady rotation of the distributor, an optimal running capability can be achieved here with minimal play and great high pressure tightness of the fuel injection pump.

The invention will be better understood and further objects and advantages thereof will become more apparent from the ensuing detailed description of preferred embodiments taken in conjunction with the drawing.

BRIEF DESCRIPTION OF THE DRAWING

FIG. 1 shows a partial section through a distributor fuel injection pump of the radial piston pump type.

DESCRIPTION OF THE PREFERRED EMBODIMENTS

In the fuel distributor injection pump shown in the drawing, a housing bore 2 is let into a housing 1 in the form of a blind bore or a bore that is closed on one end; a part that is embodied in the form of a distributor 3 is supported so that it can move, in this case, and rotate in this bore. On its end protruding from the housing bore 2, the distributor 3 has a collar 4 in which cylinder bores 5 are disposed, the cylinder bores run radial to the longitudinal axis of the distributor 3 and in which pump pistons are guided, which in the inner part of the cylinder bores, enclose a common pump work chamber that serves as a high pressure source and is not shown in detail here. The pump pistons are driven to reciprocate in a sealed and sliding manner by means of intrinsically known cam means not shown in detail here, e.g. by means of an annular cam path on which rolling shoes slide that are each connected to a pump piston. The cam ring in this case is embodied as a fixed cam ring, while at the same time the distributor drive, which is not shown in detail, carries out the relative movement of the rolling shoes along the cam path via the rotating motion of the distributor and is consequently used to drive the pump piston. With the inward stroke of the pump piston, in the pump work chamber a fuel pressure is produced which is of the magnitude of the fuel injection pressure. The fuel is conveyed from the pump work chamber via a pressure line 7 in the distributor 3 to an exit opening in the form of a distributor opening 8 on the jacket face 9 of the distributor. In the region of the mouth of the distributor opening in the jacket face, injection lines 11 are provided in the housing 1, which lead from the housing bore 2 and each lead to a fuel injection valve, not shown in detail, in order to bring the fuel there, which has been brought to high pressure, to injection in the engine. Also, per association with the respective fuel injection line 11, the high fuel injection pressure exists only as long as a solenoid valve that controls injection time and injection quantity is closed; only the valve member 15 of this solenoid valve is shown here. Via this solenoid valve, a connecting line 16 is constituted from the distributor opening 8 to a relief chamber. Consequently when the valve is open, the fuel displaced by the pump piston 6 is supplied to the relief chamber in a more or less pressure free state, in any case at a pressure below the fuel injection pressure. Distributor fuel injection pumps of this type are known for example from DE-A1-43 39 948, U.S. patent application Ser. No. 08/454,359, filed Jun. 16, 1995. Due to the one-sidedness of the position of the distributor opening on the jacket face 9 of the distributor 3 on the one hand and an intentional, very precise fit between distributor diameter and diameter of the housing bore 2 in order to produce a great high pressure tightness, brings about the disadvantage that in the borderline case, the rotationally driven distributor is no longer sufficiently supplied and lubricated with fuel inside the housing bore 2. This fuel enters into the gap between jacket face 9 and housing bore 2 as leakage fuel. In the borderline case, when there are high surface pressures, a sufficient lubricant wedge cannot be built up between the parts that are moved in relation to each other. A pressure field 17 is symbolically depicted in the drawing, in the region of the exit of the distributor opening 8.

To solve the above-described problem, one or more annular grooves 18 are now let into the jacket face of the distributor, two grooves in the current example. These grooves are small in depth and width and perform the function of conveying fuel from the pressure field 17 to the side of the jacket face 9 disposed diametrically opposite the distributor opening 8 or to the side of the gap located there between the distributor jacket face and the housing bore. Between the pressure field 17 and a counterpressure field 20 being formed on the opposite side, a pressure compensation is achieved in such a way that the pressure is built up better on the most heavily loaded side of the distributor and this side is supplied with sufficient fuel via the annular grooves 18 to maintain the lubricating film there, which has the function of carrying the distributor 3 in the housing bore 2, the distributor being influenced by lateral forces. With the aid of these grooves, it is always assured that an uninterrupted fuel film remains between the two parts 3 and 2.

The annular grooves are disposed in regions of the distributor 3 that are not interrupted by any other bore. In particular, this measure which improves the bearing of the distributor is disposed on its end remote from the drive end or the collar 4, inside the housing bore. Because of the drive end loading and the influence of forces from the pumping drive of the pump piston, the distributor is subject to tilting moments which lead to considerable dynamic effects, particularly on its end disposed inside the housing bore 2. The improvement of the bearing in this region is particularly effective as well.

Instead of letting the annular grooves into the jacket face of the distributor 3, it is naturally also possible to provide corresponding grooves inside the inner wall of the housing bore.

Another effect of this improved bearing is that the distributor is better centered in the housing bore 2, that the bearing gap between the jacket face of the distributor 3 and the housing bore 2 is embodied of a uniform thickness over the entire circumference and that as a result, the leakage losses are reduced or the high pressure tightness is increased. In this way, the consequently improved fuel injection pump is suited for producing higher fuel injection pressures which in the end, results in an improved injection with a reduction of emission values and less of a strain on the environment. Also, material pairings that are prone to scoring have less tendency toward damage with this embodiment.

The improved bearing of a rotating part, the distributor, is shown here in the example of a radial piston distributor pump. The measures provided here, though, can be realized in just as favorable a manner in fuel injection pumps that are embodied differently, such as fuel injection pumps with reciprocating pistons or fuel injection pumps with pistons that reciprocate and are driven to rotate at the same time. With moving parts of this kind, better bearing properties of the moving part can be achieved.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the united states is:

1. A fuel injection pump for internal combustion engines comprising a moving part (3) supported in a housing bore (2), said moving part has a fuel exit opening (8) on a jacket face (9), which opening is supplied with fuel under high pressure by a high pressure source on the jacket face (9) of the part (3) or in a wall of the housing bore (2) axially adjacent to the exit opening (8), at least one annular groove (18) is provided, which is always closed by the wall of the housing bore.

2. The fuel injection pump according to claim 1, in which the moving part is a distributor (3) that is driven to rotate and has a distributor opening (8) as an exit opening, said exit opening is periodically supplied with fuel under high pressure and in the course of the rotation of the distributor (3), connects with different injection lines (11) in succession, which are disposed on the circumference of the distributor (3) and feed into the housing bore (2), in order to transmit the fuel, which is fed to the distributor opening (8) under high pressure, to each of the injection valves.

3. The fuel injection pump according to claim 1, in which the at least one annular groove (18) is disposed on an end of the distributor (3) remote from its drive, in a region of an interior of the housing bore (2).

4. The fuel injection pump according to claim 2, in which the at least one annular groove (18) is disposed on an end of the distributor (3) remote from its drive, in a region of an interior of the housing bore (2).

5. The fuel injection pump according to claim 1, in which the distributor is only driven to rotate.

* * * * *